US006393649B1

(12) United States Patent
Cochrane

(10) Patent No.: US 6,393,649 B1
(45) Date of Patent: May 28, 2002

(54) BROOM HANDLE MOUNTING MEANS

(76) Inventor: Ivan Robert Cochrane, 17 Fletching Avenue, Essexwold, Bedfordview, South (ZA)

( * ) Notice: Subject to any disclaimer, the term of this patent is extended or adjusted under 35 U.S.C. 154(b) by 12 days.

(21) Appl. No.: 09/608,214

(22) Filed: Jun. 30, 2000

(30) Foreign Application Priority Data

Jun. 30, 1999 (ZA) ..... 99/4287

(51) Int. Cl.[7] ..... B25G 3/00
(52) U.S. Cl. ..... 15/175; 15/146
(58) Field of Search ..... 15/146, 147.2, 15/148, 154, 171, 175

(56) References Cited

U.S. PATENT DOCUMENTS 866,149 A * 9/1907 Lieskar
1,906,902 A * 5/1933 Firestone et al.
2,922,179 A * 1/1960 Lundgren
3,239,280 A * 3/1966 Fielder
3,937,584 A * 2/1976 Freeman
D392,103 S * 3/1998 Zaccheria
6,134,739 A * 10/2000 Gonzales

FOREIGN PATENT DOCUMENTS

ZA 562502 8/1956
ZA 846025 8/1984

* cited by examiner

*Primary Examiner*—Terrence R. Till
(74) *Attorney, Agent, or Firm*—Birch, Stewart, Kolasch & Birch, LLP

(57) ABSTRACT

This invention relates to a brace for mounting a broom handle onto a broom head. The brace includes a strip of wire which is deformed to define two tines for engagement with parallel holes bored through a wooden portion of the broom head, and to define a generally U-shaped recess for receiving the broom handle. The strip of wire is also deformed to define support surfaces for supporting a nut and bolt, which tension the generally u-shaped recess about the broom handle when a broom handle has been inserted into the broom head.

12 Claims, 2 Drawing Sheets

BROOM HANDLE MOUNTING MEANS

BACKGROUND OF THE INVENTION

THIS invention relates to mounting means for mounting a broom handle on to a broom head.

Braces for mounting broom handles to broom heads are well known in the art. The main requirements for a brace is that it be strong and durable and that it be relatively inexpensive to manufacture.

An example of a brace for attaching a broom handle to a broom head is disclosed in South African patent no. 56/2502. This brace includes a socket or sleeve for receiving the lower end of the broom handle and a pair of symmetrical brace members connected to the socket or sleeve. The symmetrical brace members are arranged to connect with the broom head. In the manufacturing process, the socket or sleeve and brace members first have to be formed and then have to be connected to each other. This connecting step is labour intensive and time consuming.

Another example of a brace for attaching a broom handle to a broom head is disclosed in South African patent no. 84/6025. This brace is made from a length of spring wire which has been deformed to define two tines for engagement with the broom head and a collar formation which engages with the broom handle. The collar is arranged to exert a transverse pressure on the broom handle once the handle has been located in a socket in the broom head to hold the handle in position on the broom head. The problem with this brace is that it does not hold the handle securely and the handle pops out of the socket during use.

It is an object of this invention to provide an improved broom handle mounting means.

SUMMARY OF THE INVENTION

According to the invention there is provided mounting means for mounting a broom handle on to a broom head, the mounting means including:

a strip of wire which is deformed to define two tines for engagement with the broom head and also to define a recess for receiving a broom handle: and tensioning means for tensioning the recess for receiving a broom handle about a broom handle.

Preferably, the strip of wire is deformed to define two opposed support surfaces for supporting the tensioning means.

The support surfaces for supporting the tensioning means are typically defined by the apices of two opposed v-shaped recesses which are oriented perpendicular relative to the recess for receiving the broom handle.

Advantageously, the support surfaces for supporting the tensioning means are arranged to extend beyond a broom handle inserted into the recess for receiving a broom handle.

The recess for the broom handle may be generally u-shaped.

Advantageously, the strip of wire is galvanized high tensile mild steel.

The tensioning means is typically a nut and bolt.

DETAILED DESCRIPTION

Figure 1:
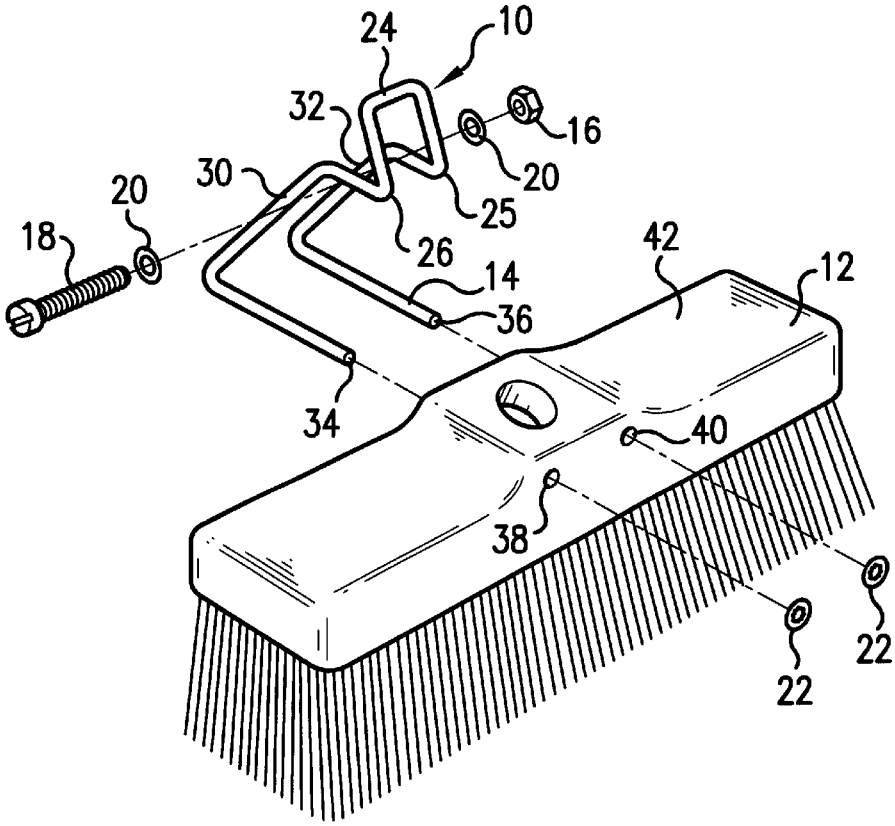
FIG. 1 is a pictorial view of broom handle mounting means according to a first embodiment of the invention and a broom head.

Referring to FIG. 1, according to a first embodiment of the invention, there is provided broom handle mounting means 10 for mounting a broom handle (not shown) to a broom head 12. The mounting means 10 comprises a deformed strip of wire 14, an internally threaded nut 16, a complementally threaded bolt 18, washers 20 and push-on fix connectors 22.

The strip of wire 14 is 5 mm in diameter and made from high tensile mild steel, preferably galvanised high tensile mild steel, with a tensile strength of about 450 MPA but could it be from 400 to 700 MPA.

The wire 14 is deformed to provide a generally u-shaped recess 24 which is arranged to receive and hold a broom handle (not shown), and also to provide two opposed v-shaped recesses 26 and 28 which are arranged to lie perpendicular relative to the u-shaped recess 24. The wire portions at the apices of the v-shaped recesses 26 and 28 are arranged to define opposed support surfaces for supporting the tensioning means in the form of the nut 16, bolt 18 and washers 20. The strip of wire 14 is further deformed to form two downwardly extending opposed support members 30 and 32 which are bent at their lower ends to form two opposed, parallel tines 34 and 36 which are arranged to be received in parallel holes 36 and 40 bored through a wooden portion 42 of the broom head 12.

Figure 2:
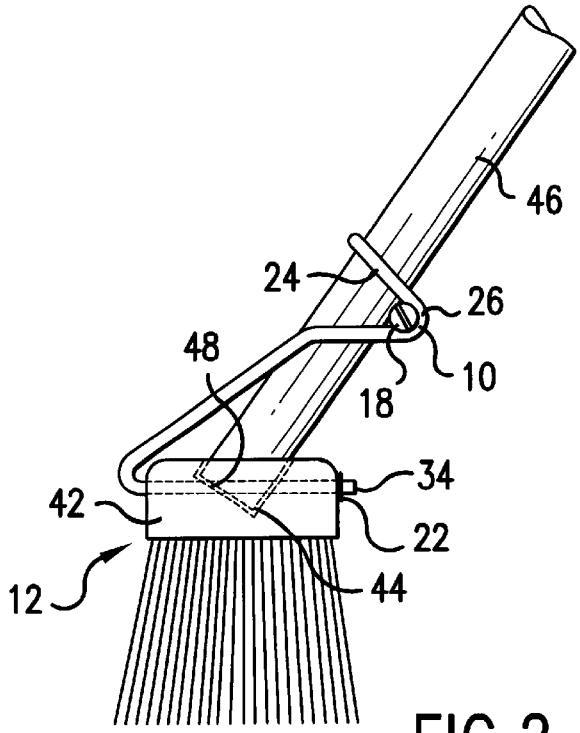
FIG. 2 is a side view of a broom handle mounted to a broom head by way of the mounting means of FIG. 1.

Referring to FIG. 2, in use, the tines 34 and 36 of the mounting means 10 are inserted into the holes 38 and 40 in the broom head 12 and are fastened in position by way of the push-on fix connectors 22. Alternatively, the ends of the tines could be threaded and they could be connected to the broom by way of complementally threaded nuts (not shown). The end 44 of a broom handle 46 is then placed in a socket 48 formed in the wooden part 42 of the broom head 12. The broom handle 46 is then placed in the u-shaped recess 34 of the mounting means 10 and is clamped/fastened in the recess by way of the nut 16, bolt 18 and washers 20 which are supported by the apices of the v-shaped recesses 26 and 28. It will be noted that the apices of the v-shaped recess 26 and 28 (i.e. the support surfaces) extend beyond the broom handle 46 so that they can receive and support the tensioning means.

Figure 3:
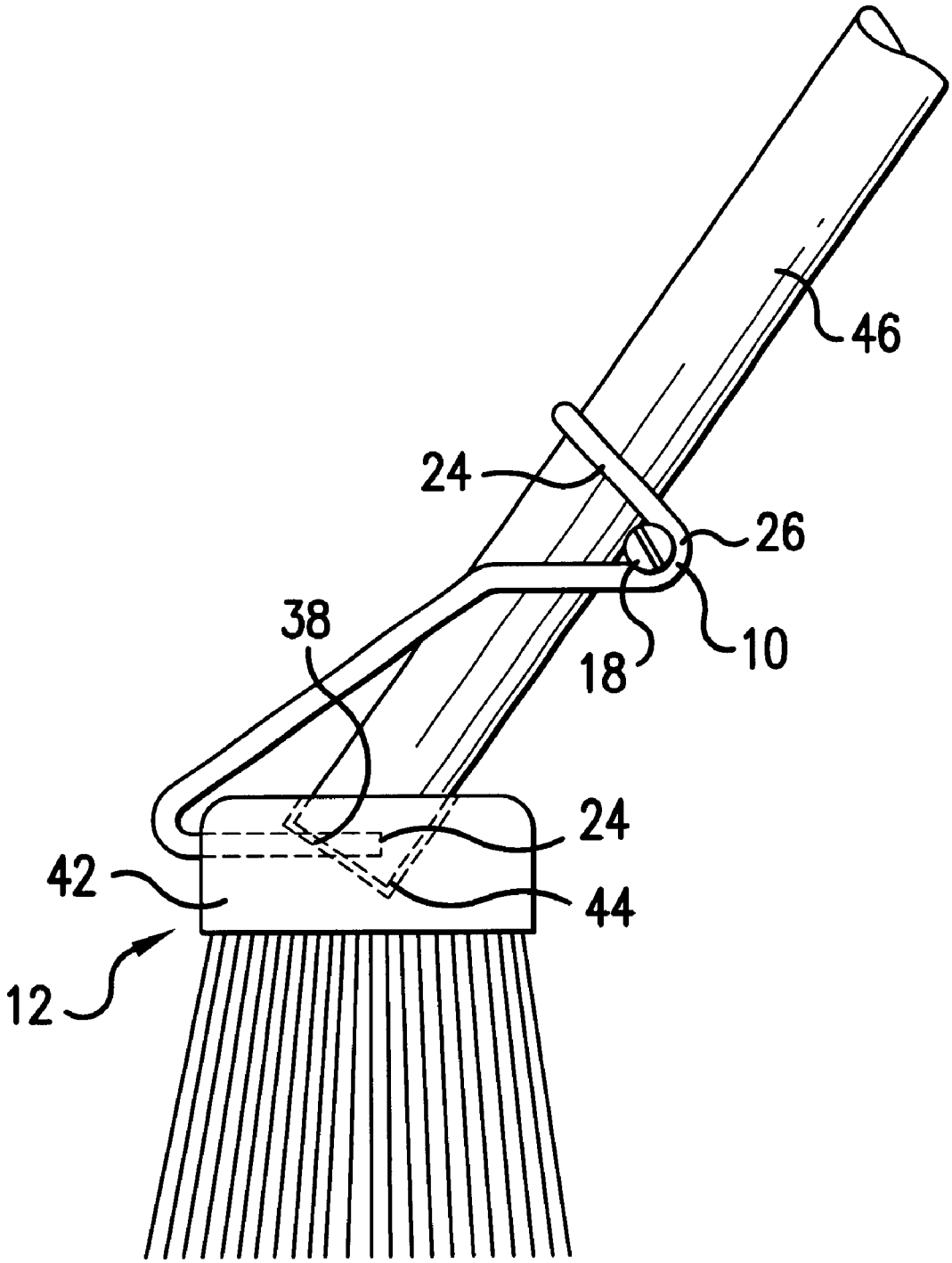
FIG. 3 is a side view of a broom handle mounted to a broom head by way of a mounting means according to a second embodiment of the invention.

FIG. 3 shows another embodiment of the invention. In this embodiment, the parallel holes 38 and 40 (only 38 is show in this view), do not extend all the way through the wooden portion 42 of the broom head 12, and the tines 24 and 26 (only 24 is shown) also do not extend all the way through the wooden portion 42 of the broom head 12. Although this mounting means 10 is not as robust as that illustrated in FIG. 2, it has the advantage that it does not require the step of affixing push connectors or bolts to the ends of the tines, and is thus less time-consuming to assemble.

The advantage of the mounting means 10 according to the invention is that it is strong and durable, holds the broom handle securely it is relatively easy to manufacture, relatively easy to assemble and inexpensive to produce. Further, the use of galvanised which tensile mild steel means that the costly and time consuming step of sending the wire clamps to a galvaniser for galvanising, is avoided.

I claim:

1. A mounting means for mounting a broom handle on to a broom head, the mounting means including:

a strip of wire which is deformed to define two tines for engagement with the broom head and also to define a handle recess for receiving a broom handle, the strip of wire is deformed to define two opposed support surfaces for supporting a tensioning means for tensioning the handle recess about a broom handle.

2. The mounting means according to claim 1, wherein the support surfaces for supporting the tensioning means are defined by the apices of two opposed v-shaped recesses which are oriented perpendicular relative to the handle recess.

3. The mounting means according to claim 2, wherein the support surfaces for supporting the tensioning means are arranged to extend beyond a broom handle inserted into the handle recess.

4. The mounting means according to claim 3, wherein the handle recess is generally u-shaped.

5. The mounting means according to claim 4, wherein the strip of wire is galvanised high tensile mild steel.

6. The mounting means according to claim 1, wherein the tensioning means is a nut and bolt.

7. A mounting means for attachment to a broom handle, mounting means including:

a strip of wire which is deformed to define a handle recess for receiving a broom handle, the strip of wire is deformed to define two opposed support surfaces for supporting a tensioning means for tensioning the handle recess about a broom handle.

8. The mounting means according to claim 7, wherein the support surfaces for supporting the tensioning means are defined by the apices of two opposed v-shaped recesses which are oriented perpendicular relative to the handle recess.

9. The mounting means according to claim 7, wherein the support surfaces for supporting the tensioning means are arranged to extend beyond a broom handle inserted into the handle recess.

10. The mounting means according to claim 7, wherein the handle recess is generally u-shaped.

11. The mounting means according to claim 7, wherein the strip of wire is galvanised high tensile mild steel.

12. The mounting means according to claim 7, wherein the tensioning means is a nut and bolt.

* * * * *